US012778237B2

(12) United States Patent
Munger et al.

(10) Patent No.: US 12,778,237 B2
(45) Date of Patent: Nov. 3, 2026

(54) RAPID-ENTRY FOOTWEAR HAVING A HEEL BOW DYNAMIC PORTION

(71) Applicant: FAST IP, LLC, Lindon, UT (US)

(72) Inventors: Seth Munger, Springville, UT (US); Craig Cheney, Lindon, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 18/378,055

(22) Filed: Oct. 9, 2023

(65) Prior Publication Data

US 2024/0032645 A1 Feb. 1, 2024

Related U.S. Application Data

(63) Continuation of application No. PCT/US2022/024501, filed on Apr. 12, 2022.

(60) Provisional application No. 63/173,865, filed on Apr. 12, 2021.

(51) Int. Cl.
*A43B 11/00* (2006.01)

(52) U.S. Cl.
CPC ..... *A43B 11/00* (2013.01)

(58) Field of Classification Search
CPC ..... A43B 11/00; A43B 11/02; A43B 23/027; A43B 21/42; A43C 11/008
See application file for complete search history.

(56) References Cited

U.S. PATENT DOCUMENTS

| | | | |
|---|---|---|---|
| 112,439 | A | 3/1871 | Francis |
| 287,312 | A | 10/1883 | Packard |
| 736,156 | A | 8/1903 | Roberts |
| 808,948 | A | 1/1906 | Roberts |
| 827,330 | A | 7/1906 | Tillson |
| 863,549 | A | 8/1907 | Metz |
| 881,153 | A | 3/1908 | Rickert |
| 921,461 | A | 5/1909 | Rickert |
| 923,860 | A | 6/1909 | Kroell |
| 1,081,678 | A | 12/1913 | Meyer |
| 1,116,462 | A | 11/1914 | Moran |
| 1,266,620 | A | 5/1918 | Peabody |
| 1,464,342 | A | 8/1923 | Rothacher |
| 1,494,236 | A | 5/1924 | Greathouse |
| 1,686,175 | A | 10/1928 | Read |

(Continued)

FOREIGN PATENT DOCUMENTS

| | | | |
|---|---|---|---|
| CN | 2438353 | Y | 7/2001 |
| CN | 1403041 | A | 3/2003 |

(Continued)

OTHER PUBLICATIONS https://us.ecco.com/ecco-biom-fjuel-mens-outdoor-shoe-837594.html?dwvar_837594_color=00001 submitted herewith as of Jun. 1, 2016.

(Continued)

*Primary Examiner* — Jameson D Collier

(57) ABSTRACT

A rapid-entry shoe having a sole portion, an upper coupled to the sole portion, and a heel bow. The heel bow extends around the rear portion of the shoe and has a heel bow dynamic portion located above an opening topline of the shoe. In an open configuration, the heel bow dynamic portion is pivoted downward to facilitate entry of the foot into the shoe, while in a closed configuration, the heel bow dynamic portion is returned upward to facilitate retention of the foot inside the shoe.

10 Claims, 7 Drawing Sheets

(56) References Cited

U.S. PATENT DOCUMENTS 1,926,818 A 9/1933 Rateliff
2,069,752 A 2/1937 Dorr
2,083,390 A 6/1937 Murena
2,118,019 A 5/1938 Benjafield
2,266,732 A 12/1941 Babinchak
2,297,594 A 9/1942 Weinstat
2,368,514 A 1/1945 Baehr
2,450,250 A 9/1948 Napton
2,452,502 A 10/1948 Tarbox
2,693,039 A 11/1954 Balut
2,736,110 A 2/1956 Hardimon
2,763,071 A 9/1956 Napier
2,829,448 A 4/1958 Minera
2,920,402 A 1/1960 Minera
3,000,116 A 9/1961 Ally
3,014,288 A 12/1961 Evans et al.
3,040,454 A 6/1962 Topper et al.
3,097,438 A 7/1963 Evans
3,146,535 A 9/1964 Owings
3,192,651 A 7/1965 Smith
3,373,512 A 3/1968 Jacobson
3,643,350 A 2/1972 Paoletta et al.
3,798,802 A 3/1974 Saunders
4,489,509 A 12/1984 Libit
4,590,690 A 5/1986 Pfander
4,596,080 A 6/1986 Benoit et al.
4,805,321 A 2/1989 Tonkel
4,811,502 A 3/1989 Barret
4,924,605 A 5/1990 Spademan
4,972,613 A 11/1990 Loveder
4,979,319 A 12/1990 Hayes
5,054,216 A 10/1991 Lin
5,090,140 A 2/1992 Sessa
5,127,170 A 7/1992 Messina
5,174,050 A 12/1992 Gabrielli
5,181,331 A 1/1993 Berger
5,184,410 A 2/1993 Hamilton
5,257,470 A 11/1993 Auger et al.
5,259,126 A 11/1993 Rosen
5,265,353 A 11/1993 Marega et al.
5,282,327 A 2/1994 Ogle
5,311,678 A 5/1994 Spademan
5,341,583 A 8/1994 Hallenbeck
5,351,583 A 10/1994 Szymber et al.
5,371,957 A 12/1994 Gaudio
5,430,961 A 7/1995 Faulconer et al.
5,467,537 A 11/1995 Aveni et al.
5,481,814 A 1/1996 Spencer
5,784,808 A * 7/1998 Hockerson ..... A43B 13/181 36/102
5,806,208 A 9/1998 French
5,842,292 A 12/1998 Siesel
5,846,063 A 12/1998 Lakic
5,983,530 A 11/1999 Chou
5,997,027 A 12/1999 Jungkind
6,000,148 A 12/1999 Cretinon
6,014,823 A 1/2000 Lakic
6,125,555 A 10/2000 Schenkel
6,128,837 A 10/2000 Huang
6,170,173 B1 1/2001 Caston
6,189,239 B1 2/2001 Gasparovic et al.
6,290,559 B1 9/2001 Scott
6,321,466 B1 11/2001 Bordin et al.
6,360,454 B1 3/2002 Dachgruber et al.
6,367,171 B1 4/2002 Burt
6,378,230 B1 4/2002 Rotem et al.
6,470,537 B1 10/2002 Schallenkamp
6,643,954 B2 11/2003 Voswinkel
6,671,980 B1 1/2004 Liu
6,684,533 B1 2/2004 Su
6,839,985 B2 1/2005 Bettiol
6,877,252 B2 4/2005 Wilkinson
6,922,917 B2 8/2005 Kerns et al.
6,925,732 B1 8/2005 Clarke
6,938,361 B2 9/2005 Su
7,059,068 B2 6/2006 Magallanes et al.
7,103,994 B2 9/2006 Johnson
7,178,270 B2 2/2007 Hurd et al.
7,225,563 B2 6/2007 Chen et al.
7,439,837 B2 10/2008 Mcdonald
D583,956 S 12/2008 Chang et al.
7,661,205 B2 2/2010 Johnson
7,685,747 B1 3/2010 Gasparovic et al.
7,757,414 B2 7/2010 Tonkel
7,793,438 B1 9/2010 Busse et al.
7,823,299 B1 11/2010 Brigham
7,975,403 B2 7/2011 Mosher
D648,512 S 11/2011 Schlageter et al.
8,065,819 B2 11/2011 Kaufman
8,161,669 B2 4/2012 Keating
8,225,535 B2 7/2012 Dillenbeck
8,302,329 B2 11/2012 Hurd et al.
8,333,021 B2 12/2012 Johnson
8,745,901 B2 6/2014 Toraya
8,769,845 B2 7/2014 Lin
9,119,441 B2 9/2015 Frappier
9,314,067 B2 4/2016 Bock
9,351,532 B2 5/2016 Mokos
9,615,624 B2 4/2017 Kilgore et al.
9,629,416 B2 4/2017 Rackiewicz et al.
9,635,905 B2 5/2017 Dekovic
9,675,132 B2 6/2017 Marshall
9,717,304 B2 8/2017 Bernhard et al.
9,820,527 B2 11/2017 Pratt et al.
9,848,674 B2 12/2017 Smith et al.
9,999,278 B2 6/2018 Feinstein
10,306,947 B2 6/2019 Pratt et al.
10,327,515 B2 6/2019 Peyton et al.
D854,303 S 7/2019 Flanagan et al.
10,455,898 B1 10/2019 Orand et al.
10,499,707 B2 12/2019 Hobson et al.
10,506,842 B2 12/2019 Pratt et al.
10,537,154 B2 1/2020 Smith et al.
10,568,382 B2 2/2020 Hatfield et al.
10,609,981 B1 4/2020 Phinney
10,617,174 B1 4/2020 Hopkins et al.
10,638,810 B1 5/2020 Cheney et al.
10,660,401 B1 5/2020 Pratt et al.
10,765,167 B2 9/2020 Azoulay et al.
10,791,796 B1 10/2020 Baker
10,813,405 B2 10/2020 Pratt
10,905,192 B1 2/2021 Cheney
10,912,348 B2 2/2021 Owings et al.
10,973,278 B2 4/2021 Raia
10,973,279 B2 4/2021 Cheney et al.
11,000,091 B1 5/2021 Kyle
11,064,761 B2 7/2021 Cheney
11,140,941 B2 10/2021 Xanthos et al.
11,154,113 B2 10/2021 Hatfield et al.
11,172,727 B2 11/2021 Hatfield et al.
11,191,320 B2 12/2021 Happen
11,213,098 B2 1/2022 Beers et al.
11,234,482 B2 2/2022 Roser
D948,190 S 4/2022 Jury
D948,191 S 4/2022 Holmes
D949,540 S 4/2022 Jury
D949,544 S 4/2022 Witherow
D955,732 S 6/2022 Kelley
11,490,680 B2 11/2022 Cheney et al.
11,607,002 B2 3/2023 Cheney
11,622,598 B2 4/2023 Bar
11,633,006 B2 4/2023 Pratt et al.
11,633,016 B2 4/2023 Orand et al.
11,707,113 B2 7/2023 Hopkins et al.
D993,601 S 8/2023 Wang et al.
11,737,511 B2 8/2023 Cheney et al.
2001/0001350 A1 5/2001 Aguerre
2002/0053147 A1 5/2002 Borsoi et al.
2002/0066213 A1 6/2002 Wells
2002/0095823 A1 7/2002 Laio et al.
2002/0144434 A1 10/2002 Farys et al.
2002/0174568 A1 11/2002 Neiley
2003/0106244 A1 6/2003 Miller et al.
2004/0003517 A1 1/2004 Marvin et al.

(56) References Cited

U.S. PATENT DOCUMENTS

2004/0088890 A1 5/2004 Matis et al.
2004/0111921 A1 6/2004 Lenormand
2005/0022428 A1 2/2005 Anderson
2005/0034328 A1 2/2005 Geer
2005/0039348 A1 2/2005 Raluy et al.
2005/0066543 A1 3/2005 Rosen et al.
2005/0198867 A1 9/2005 Labbe
2005/0241189 A1 11/2005 Elkington et al.
2007/0074425 A1 4/2007 Leong
2007/0180730 A1 8/2007 Greene et al.
2007/0209234 A1 9/2007 Chou
2007/0256329 A1 11/2007 Antonelli et al.
2007/0271822 A1 11/2007 Meschter
2007/0277394 A1 12/2007 Hansen et al.
2008/0086911 A1 4/2008 Labbe
2008/0189984 A1 8/2008 Januszewski et al.
2008/0276492 A1 11/2008 Burnett
2008/0307673 A1 12/2008 Johnson
2008/0313929 A1 12/2008 Hoyt
2010/0037483 A1 2/2010 Meschter et al.
2010/0095494 A1 4/2010 Martin
2010/0095554 A1 4/2010 Gillespie
2010/0251572 A1 10/2010 Baudouin et al.
2011/0016751 A1 1/2011 Somerville
2011/0146106 A1 6/2011 Kaufman
2011/0185592 A1 8/2011 Nishiwaki et al.
2011/0214313 A1 9/2011 James et al.
2011/0239489 A1 10/2011 Iuchi et al.
2011/0277350 A1 11/2011 Huynh
2012/0055044 A1 3/2012 Dojan et al.
2012/0060395 A1 3/2012 Blevens et al.
2012/0151799 A1 6/2012 Weinreb
2012/0167413 A1 7/2012 Marvin et al.
2012/0216429 A1 8/2012 Bastida et al.
2012/0317839 A1 12/2012 Pratt
2013/0160328 A1 6/2013 Hatfield et al.
2013/0185959 A1 7/2013 Coleman
2013/0219747 A1 8/2013 Lederer
2013/0312285 A1 11/2013 Sharma et al.
2014/0013624 A1 1/2014 Stockbridge et al.
2014/0090274 A1 4/2014 Arquilla
2014/0101975 A1 4/2014 Ueda
2014/0123516 A1 5/2014 Cressman et al.
2014/0173932 A1 6/2014 Bell
2014/0189964 A1 7/2014 Wen et al.
2014/0202044 A1 7/2014 Adami et al.
2014/0259781 A1 9/2014 Sakai
2014/0298687 A1 10/2014 Flinterman et al.
2014/0305005 A1 10/2014 Yeh
2014/0373396 A1 12/2014 Chang
2015/0013184 A1 1/2015 Beers
2015/0013189 A1 1/2015 Hanak et al.
2015/0020416 A1 1/2015 Wiens
2015/0047222 A1 2/2015 Rushbrook
2015/0047223 A1 2/2015 Flinterman et al.
2015/0165338 A1 6/2015 Choe
2015/0216252 A1 8/2015 Wiens
2015/0305432 A1 10/2015 Wiens
2015/0305442 A1 10/2015 Ravindran
2016/0007674 A1 1/2016 Labonte et al.
2016/0128424 A1 5/2016 Connell et al.
2016/0262492 A1 9/2016 Fujita et al.
2016/0374427 A1 12/2016 Zahabian
2017/0013915 A1 1/2017 Caston, Jr.
2017/0035148 A1 2/2017 Marvin et al.
2017/0127755 A1 5/2017 Bunnell et al.
2017/0215525 A1 8/2017 Labbe
2017/0265562 A1 9/2017 Mullen
2017/0303632 A1* 10/2017 Pratt ..... A43B 23/0275
2017/0360151 A1 12/2017 Pratt
2018/0110287 A1 4/2018 Hopkins et al.
2018/0110292 A1 4/2018 Beers et al.
2018/0199659 A1 7/2018 Lintaman
2018/0235314 A1 8/2018 Farage
2018/0255865 A1 9/2018 Hsu
2018/0263332 A1 9/2018 Bruno
2018/0289109 A1 10/2018 Beers et al.
2018/0295942 A1 10/2018 Drake
2018/0338572 A1 11/2018 Cross et al.
2018/0343968 A1 12/2018 James et al.
2019/0053571 A1 2/2019 Bjornson et al.
2019/0116916 A1 4/2019 Burch
2019/0281920 A1 9/2019 Ito et al.
2019/0289960 A1 9/2019 Loveder
2019/0297999 A1 10/2019 Nakaya et al.
2019/0307208 A1 10/2019 Corcoran-Tadd et al.
2019/0365029 A1 12/2019 Cross et al.
2019/0366667 A1 12/2019 Cross et al.
2020/0000178 A1 1/2020 Pratt et al.
2020/0015544 A1 1/2020 Pratt
2020/0037703 A1 2/2020 Twist
2020/0046066 A1 2/2020 Difrancisco
2020/0068991 A1 3/2020 Steere et al.
2020/0085136 A1 3/2020 Pratt et al.
2020/0113274 A1 4/2020 Butler
2020/0187590 A1 6/2020 Hopkins et al.
2020/0196703 A1 6/2020 Hopkins
2020/0196787 A1 6/2020 Dament et al.
2020/0205511 A1 7/2020 Hopkins et al.
2020/0205512 A1 7/2020 Blanche et al.
2020/0205516 A1 7/2020 Kilgore
2020/0205518 A1 7/2020 Hopkins et al.
2020/0205520 A1 7/2020 Kilgore
2020/0245797 A1 8/2020 Kim
2020/0253333 A1 8/2020 Kilgore et al.
2020/0323308 A1 10/2020 Dubuisson
2020/0345105 A1* 11/2020 Beers ..... A43B 21/26
2020/0375319 A1 12/2020 Yang
2020/0383424 A1 12/2020 Hughes
2021/0030107 A1 2/2021 Pratt et al.
2021/0059351 A1 3/2021 Piacentini
2021/0068493 A1 3/2021 Pratt et al.
2021/0068494 A1 3/2021 Zahabian
2021/0112911 A1 4/2021 Pratt et al.
2021/0112916 A1 4/2021 Schulten
2021/0127788 A1 5/2021 Li
2021/0145114 A1 5/2021 Kyle
2021/0169177 A1 6/2021 Yang
2021/0186146 A1 6/2021 Erwin
2021/0204642 A1 7/2021 Kyle
2021/0204643 A1 7/2021 Kyle
2021/0204644 A1 7/2021 Kyle
2021/0204645 A1 7/2021 Pratt
2021/0227923 A1 7/2021 Love et al.
2021/0235811 A1 8/2021 Oh
2021/0282495 A1 9/2021 Davis et al.
2021/0321718 A1 10/2021 Chang
2021/0330033 A1 10/2021 Pratt et al.
2021/0337922 A1 11/2021 Cheney
2021/0345727 A1 11/2021 Raia
2021/0378356 A1 12/2021 Cheney et al.
2022/0053884 A1 2/2022 Kilgore et al.
2022/0104582 A1 4/2022 Christensen et al.
2022/0132976 A1 5/2022 Bentz
2022/0142291 A1 5/2022 Cheney et al.
2022/0240625 A1 8/2022 Shin
2022/0287406 A1 9/2022 Cheney et al.
2022/0287407 A1 9/2022 Cheney et al.
2022/0361627 A1 11/2022 Cheney et al.
2022/0369758 A1 11/2022 Pratt
2022/0378144 A1 12/2022 Pratt et al.
2022/0400810 A1 12/2022 Cheney et al.
2023/0030016 A1 2/2023 Pratt et al.
2023/0030734 A1 2/2023 Farina
2023/0033366 A1 2/2023 Farina
2023/0035573 A1 2/2023 Bar
2023/0055164 A1 2/2023 Cheney et al.
2023/0077572 A1 3/2023 Dean et al.
2023/0081272 A1 3/2023 Pratt
2023/0084256 A1 3/2023 Brilliant
2023/0218033 A1 7/2023 Cheney
2023/0225450 A1 7/2023 Cheney et al.

(56) References Cited

U.S. PATENT DOCUMENTS

| | | | |
|---|---|---|---|
| 2023/0263270 | A1 | 8/2023 | Jones |
| 2023/0276897 | A1 | 9/2023 | Cheney et al. |
| 2023/0284737 | A1 | 9/2023 | Bar |

FOREIGN PATENT DOCUMENTS

| | | | |
|---|---|---|---|
| CN | 201005111 | Y | 1/2008 |
| CN | 101991227 | A | 3/2011 |
| CN | 107467775 | A | 12/2017 |
| CN | 108577022 | A | 9/2018 |
| DE | 19534249 | A1 | 3/1997 |
| DE | 19611797 | A1 | 10/1997 |
| DE | 29809404 | U1 | 8/1998 |
| DE | 10247163 | A1 | 4/2004 |
| DE | 102004005288 | A1 | 8/2005 |
| EP | 0526892 | A2 | 2/1993 |
| EP | 1059044 | A1 | 12/2000 |
| EP | 1952715 | A1 | 8/2008 |
| EP | 3266327 | A1 | 1/2018 |
| FR | 3066679 | A1 | 11/2018 |
| GB | 2517399 | A | 2/2015 |
| JP | 01-081910 | U | 6/1989 |
| JP | 11-127907 | A | 5/1999 |
| JP | 2001-149394 | A | 6/2001 |
| JP | 2006-055571 | A | 3/2006 |
| JP | 2010-104416 | A | 5/2010 |
| JP | 2014-161721 | A | 9/2014 |
| KR | 10-2005-0095542 | A | 9/2005 |
| KR | 10-2009-0093548 | A | 9/2009 |
| KR | 10-2009-0130804 | A | 12/2009 |
| KR | 10-0936510 | B1 | 1/2010 |
| NL | 2000762 | C1 | 1/2009 |
| WO | 2007/080205 | A1 | 7/2007 |
| WO | 2009/089572 | A1 | 7/2009 |
| WO | 2009/154350 | A1 | 12/2009 |
| WO | 2017/004135 | A2 | 1/2017 |
| WO | 2018/230961 | A1 | 12/2018 |
| WO | 2019/215359 | A1 | 11/2019 |
| WO | 2020/006490 | A1 | 1/2020 |
| WO | 2020/176653 | A1 | 9/2020 |
| WO | 2021/162569 | A1 | 8/2021 |
| WO | 2022/204444 | A1 | 9/2022 |
| WO | 2022/221339 | A1 | 10/2022 |
| WO | 2023/049414 | A1 | 3/2023 |
| WO | 2023/064568 | A1 | 4/2023 |

OTHER PUBLICATIONS https://www.teva.com/kids-sandals/hurricane-drift/ 1102483C.html submitted herewith as of Jun. 13, 2019.

International Preliminary Report on Patentability received for PCT Patent Application No. PCT/US22/24501, mailed on Oct. 26, 2023, 6 pages.

International Search Report and Written Opinion received for PCT Patent Application No. PCT/US22/024501, mailed on Jul. 6, 2022, 6 pages.

Sneider, "Kizik Handsfree New York Shoe Review," https://the-gadgeteer.com/2018/06/27/kizik-handsfree-new-york-show-review/ (2018).

U.S. Provisional Application filed Jun. 29, 2015 by Zahabian., U.S. Appl. No. 62/186,148.

* cited by examiner

RAPID-ENTRY FOOTWEAR HAVING A HEEL BOW DYNAMIC PORTION

CROSS-REFERENCE TO RELATED APPLICATION

This application is a continuation of, claims priority to and the benefit of PCT Serial No. PCT/US22/24501 filed Apr. 12, 2022 and entitled "RAPID-ENTRY FOOTWEAR HAVING A HEEL BOW DYNAMIC PORTION." PCT Serial No. PCT/US22/24501 claims the benefit of U.S. Provisional Patent Application No. 63/173,865, filed Apr. 12, 2021 and entitled "RAPID-ENTRY FOOTWEAR HAVING A HEEL BOW DYNAMIC PORTION." All of the aforementioned applications are incorporated herein by reference in their entireties.

FIELD

The present disclosure relates to footwear, and more particularly to rapid-entry footwear having a heel bow dynamic portion.

BACKGROUND

Whether due to inconvenience or inability, donning and doffing of shoes, including tying or otherwise securing the same, may be undesirable and/or present difficulties to some individuals. The present disclosure addresses this need.

SUMMARY

Example embodiments of the present disclosure comprise a rapid-entry shoe having a sole portion, an upper coupled to the sole portion, and a heel bow.

In example embodiments, the upper comprises a heel portion extending around a rear portion of the rapid-entry shoe, and the upper comprises an opening defined at least in part by an opening topline for receiving a foot of a user.

In example embodiments, the heel bow extends around the rear portion of the rapid-entry shoe between a medial side and a lateral side, the heel bow extending upward and rearward from each of the medial side and the lateral side below the opening topline to converge at a heel bow dynamic portion located above the opening topline.

In example embodiments, the heel bow comprises a medial flange portion for coupling to the medial side of the sole portion and a lateral flange portion for coupling to the lateral side of the sole portion.

In example embodiments, the heel bow is resiliently deformable above the opening topline. In example embodiments, the heel portion is more rigid than the heel bow.

In example embodiments, in an open configuration, the heel bow dynamic portion is pivoted downward against the opening topline to thereby expand the opening to facilitate entry of the foot into the rapid-entry shoe. In example embodiments, in a closed configuration, the heel bow dynamic portion is returned upward from against the opening topline to thereby narrow the opening to facilitate retention of the foot inside the rapid-entry shoe.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
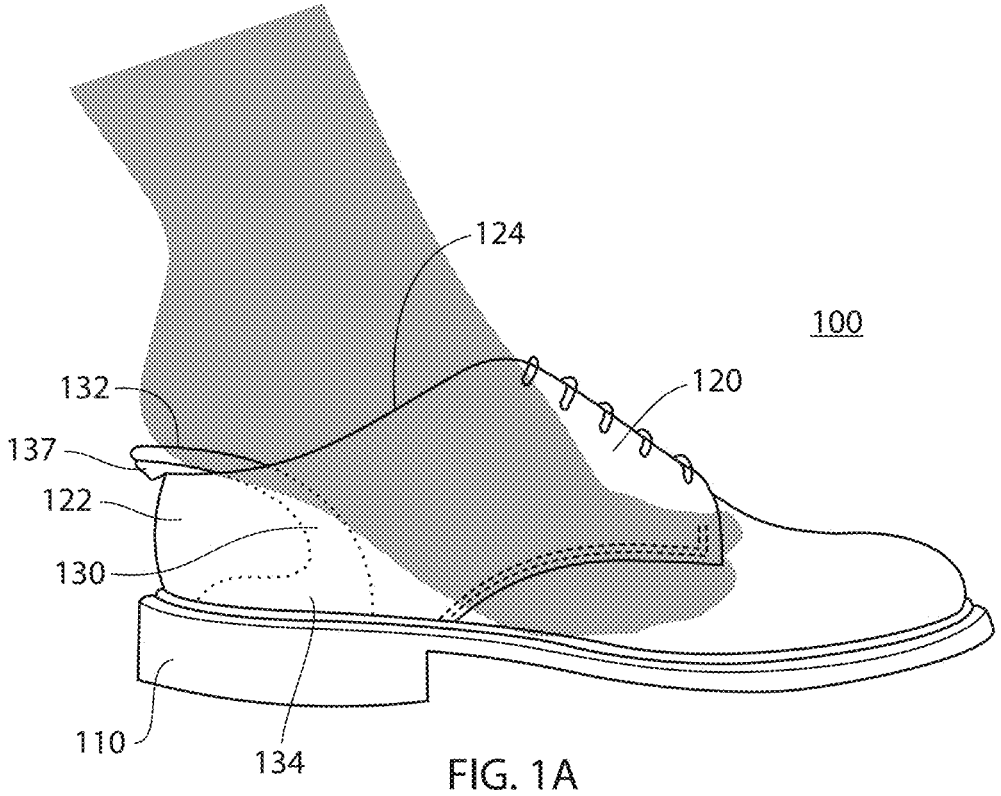
FIGS. 1A and 1B Illustrate an example embodiment of a rapid-entry shoe of the present disclosure having a heel bow dynamic portion in open and closed configurations, respectively.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, unless the context dictates otherwise, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

As used herein, unless the context dictates otherwise, a "sole portion" of a rapid-entry shoe refers to an outsole or portions thereof, a midsole or portions thereof, an insole or portions thereof, a wedge or portions thereof, or other suitable structure disposed between and/or adjacent to the foregoing parts of a rapid-entry shoe.

Figure 1B:
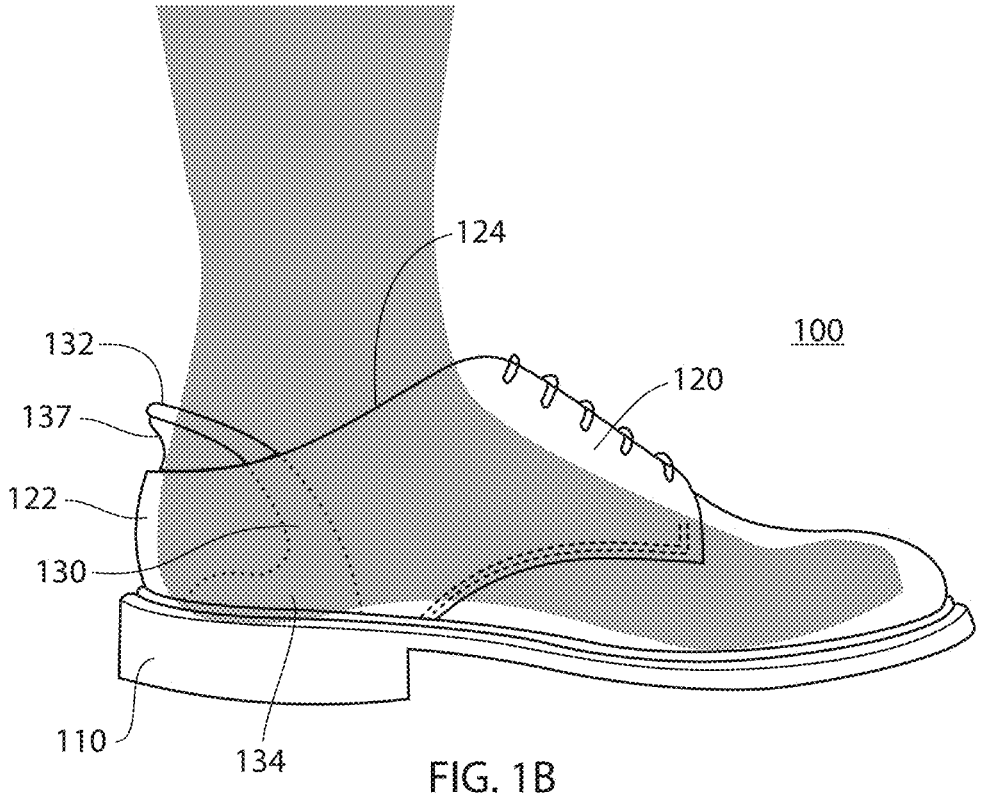

In accordance with example embodiments, and with reference to FIGS. 1A and 1B, a rapid-entry shoe 100 of the present disclosure comprises a sole portion 110 and an upper 120 coupled to the sole portion 110. In example embodiments, the upper 120 comprises a heel portion 122 (e.g., heel counter, heel collar or back strap) extending around a rear portion of the rapid-entry shoe 100. In example embodiments, the upper 120 comprises an opening defined at least in part by an opening topline 124, for receiving a foot of a user.

In accordance with example embodiments, a rapid-entry shoe 100 of the present disclosure further comprises a heel bow 130 extending (e.g., between at least two layers of the upper 120 or external to the upper 120) around the rear portion of the rapid-entry shoe 100 between a medial side of the rapid-entry shoe 100 (e.g., at the sole portion 110, or above, as described below) and a lateral side of the rapid-entry shoe 100 (e.g., at the sole portion 110, or above, as described below). In example embodiments, the heel bow 130 extends upward and rearward from each of the medial side and the lateral side below the opening topline 124 to converge at a heel bow dynamic portion 132 located above the opening topline 124.

In this regard, in example embodiments of the present disclosure, an opening topline 124 is exclusive of a heel bow dynamic portion 132 and an upper panel 137. That is, and in example embodiments of the present disclosure, an opening topline 124 does not include any portion of a heel bow dynamic portion 132 or an upper panel 137. In this regard, and in example embodiments of the present disclosure, an opening topline 124 can be defined by a top edge of an upper extending around a rigid, not resiliently deformable, static heel counter, heel collar or back strap, as applicable, and between lateral and medial quarters. Thus, a heel bow dynamic portion 132 is not merely a heel counter, heel collar or back strap in example embodiments of the present disclosure.

In this regard, in some embodiments the opening topline 124 at the heel portion 122 is lower than the tongue when viewed from the side, while in other embodiments the opening topline 124 at the heel portion 122 is substantially level with the tongue when viewed from the side.

Figure 2:
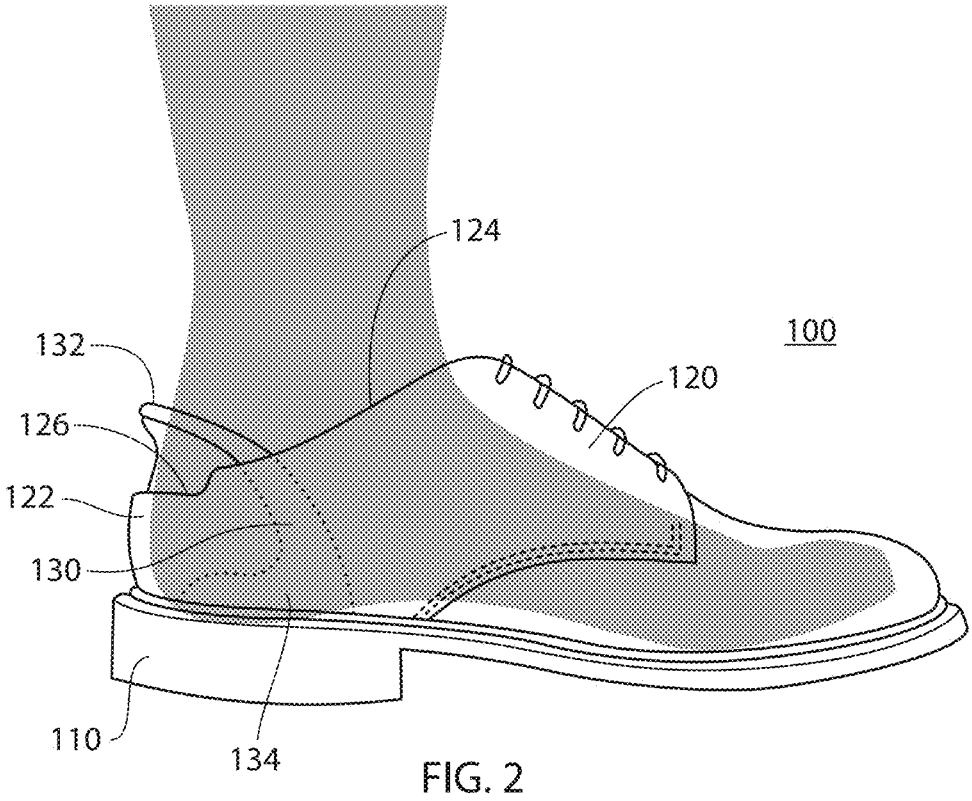
FIG. 2 Illustrates an example embodiment of a rapid-entry shoe of the present disclosure having a receptacle area for a heel bow.

In some example embodiments, and with reference to FIG. 2, an opening topline 124 comprises a step down or ramp down to a deflection zone 126 for the heel bow 130 (or the heel bow dynamic portion 132) to be received into when it is compressed to the open configuration.

In accordance with example embodiments of the present disclosure, the heel bow 130 comprises a medial flange portion 134 (e.g., extending rearward) and/or a lateral flange portion 134 (e.g., extending rearward) for coupling to a medial side of the rapid-entry shoe 100 (e.g., at the sole portion 110, or above, as described below) and/or a lateral side of the rapid-entry shoe 100 (e.g., at the sole portion 110, or above, as described below), respectively.

Figure 3A:
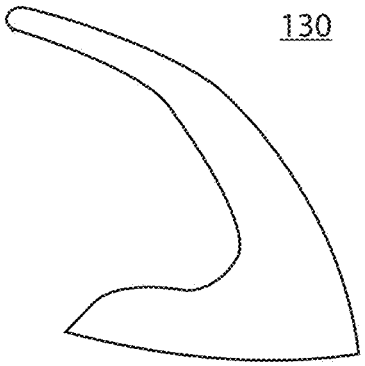
FIGS. 3A-3F Illustrate example embodiments of heel bows in accordance with the present disclosure.
Figure 3B:
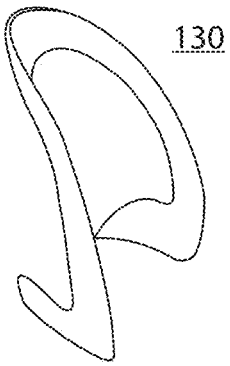

In accordance with example embodiments of the present disclosure, the medial flange portion 134 and the lateral flange portion 134 are ends of the heel bow 130 (e.g., as illustrated in FIGS. 3A and 3B). That is, in example embodiments, the heel bow 130 terminates at the medial flange portion 134 and the lateral flange portion 134.

Figure 3C:
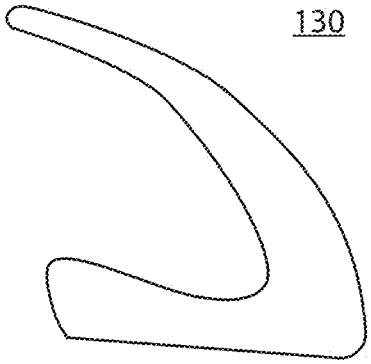
Figure 3D:
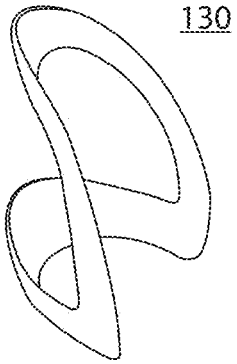
Figure 3E:
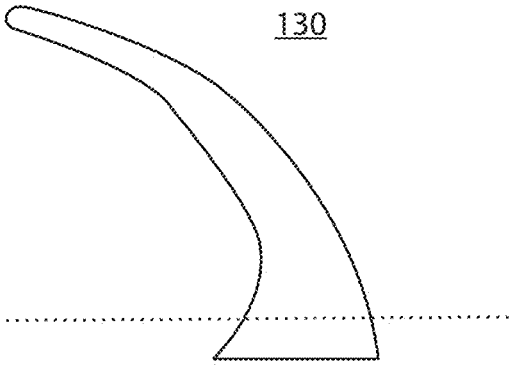
Figure 3F:
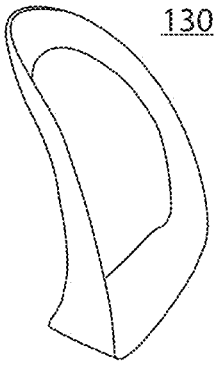

In accordance with other example embodiments, the medial flange portion 134 and the lateral flange portion 134 are coupled at the back of the heel portion 122 (e.g., as illustrated in FIGS. 3C and 3D) such that the heel bow 130 forms a closed loop. In accordance with still other example embodiments, the medial flange portion 134 and the lateral flange portion 134 are coupled through the sole portion 110 (e.g., as illustrated in FIGS. 3E and 3F, the dotted line in FIG. 3E representing the sole portion) such that the heel bow 130 forms a closed loop.

In accordance with example embodiments of the present disclosure, the heel bow 130 (e.g., at the heel bow dynamic portion 132) is resiliently deformable above the opening topline 124.

Additionally, the heel bow 130 can be resiliently deformable below the opening topline 124. Thus, in example embodiments, the heel bow 130 moves relative to the upper 120 below the opening topline 124 during transition between the open configuration and the closed configuration. In this regard, in example embodiments, during transition from a closed configuration to an open configuration, a heel bow 130 deforms both above and below an opening topline 124, while an upper 120 (e.g., heel counter, heel collar or back strap) does not deform or an upper 120 (e.g., an upper panel 137) only deforms above the opening topline 124 (i.e., the upper 120 does not deform below the opening topline 124).

Alternatively, the heel bow 130 can be resiliently deformable exclusively above the opening topline 124 (i.e., only the heel bow dynamic portion 132 is resilient, whereas the remaining portion of the heel bow 130 is rigid or more rigid than the heel bow dynamic portion 132). In this regard, in example embodiments, the heel bow 130 does not deform below the opening topline 124 during transition between the open configuration and the closed configuration. Similarly, in example embodiments, the upper 120 does not deform below the opening topline 124 during transition between the open configuration and the closed configuration.

In other embodiments, the heel bow 130 can be comprised of a resiliently deformable material below the opening topline 124, but is coupled to the upper 120 below the opening topline 124 so as to not permit relative movement between the heel bow 130 and the upper 120 below the opening topline 124. In this regard, in example embodiments, the heel bow 130 does not deform below the opening topline 124 during transition between the open configuration and the closed configuration. In such embodiments, the heel bow 130 can be uncoupled to the upper 120 above the opening topline 124 so as to permit relative movement (including deflection to an open configuration) above the opening topline 124.

In some embodiments, the heel bow 130 comprises one or more transition regions defining the heel bow dynamic portion 132, the transition region comprising a hinge (e.g., a living hinge) or a differing physical property (e.g., by having one or more of a differing material, shape, dimension or orientation). For example, the heel bow 130 can comprise a medial transition region at a medial intersection (e.g., in the closed configuration) of the opening topline 124 and the heel bow 130, and can further comprise a lateral transition region at a lateral intersection (e.g., in the closed configuration) of the opening topline 124 and the heel bow 130.

In accordance with example embodiments of the present disclosure, the heel portion 122 is rigid (e.g., more rigid than the heel bow 130) such that the heel bow dynamic portion 132 resiliently deflects over the heel portion 122 during transition to an open configuration, as discussed below.

In accordance with example embodiments of the present disclosure, and with momentary reference back to FIGS. 1A and 1B, the heel bow dynamic portion 132 is coupled to the heel portion 122 (e.g., at a window defined between the heel bow dynamic portion 132 and the opening topline 124) with an upper panel 137 that is more flexible than both the heel bow dynamic portion 132 and the heel portion 122. For example, an upper panel 137 can comprise a fabric material.

Figure 4:
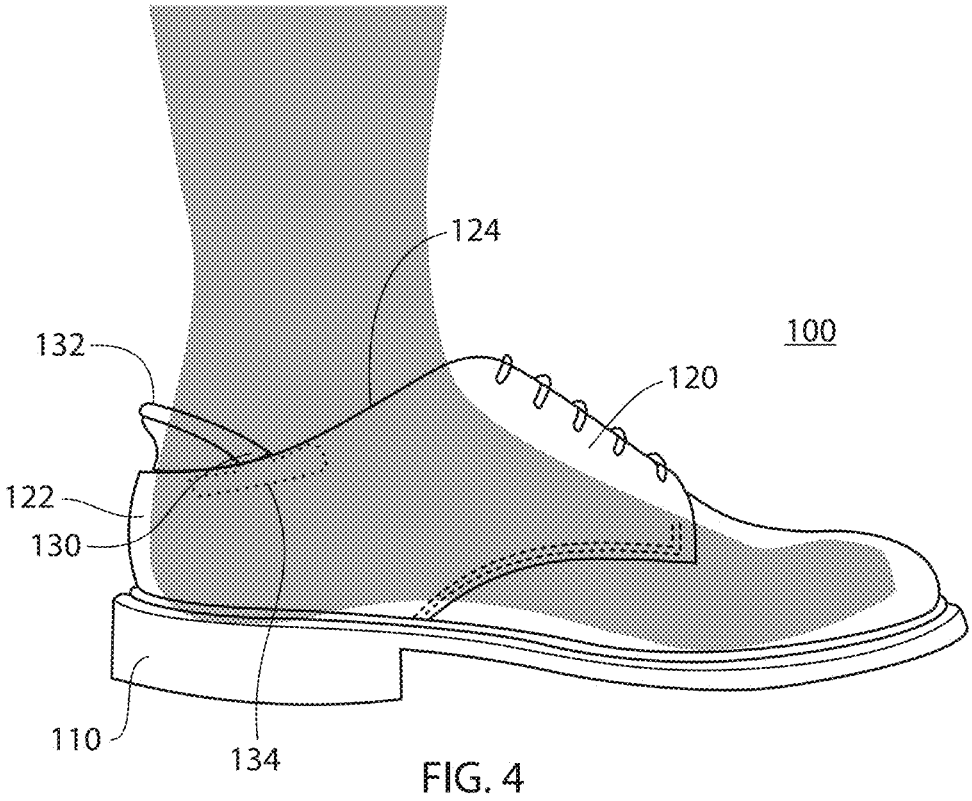
FIG. 4 Illustrates an example embodiment of a rapid-entry shoe of the present disclosure having a heel bow that does not extend to a sole portion.

While in some embodiments, a heel bow 130 comprises a medial flange portion 134 and a lateral flange portion 134 for coupling to the medial side of the sole portion 110 and the lateral side of the sole portion 110, respectively, in other embodiments, and with reference to FIG. 4, a heel bow 130 comprises a medial flange portion 134 and a lateral flange portion 134 for coupling to the medial side of the upper 120 and the lateral side of the upper 120, respectively. In this regard, in example embodiments, a heel bow 130 does not extend to a sole portion 110.

Figure 5:
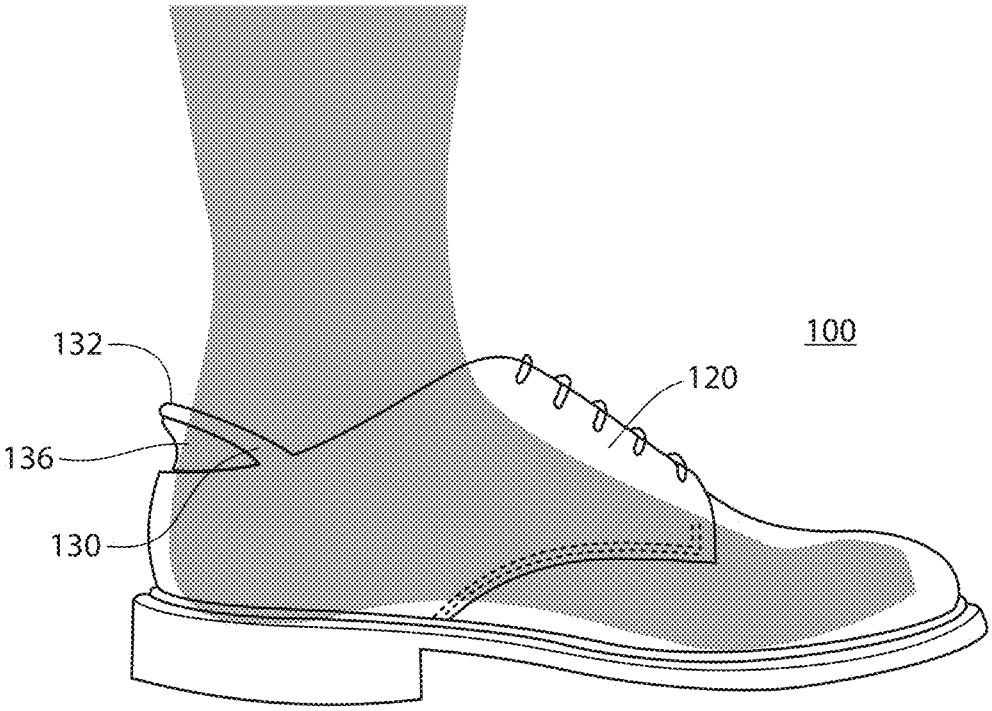
FIG. 5 Illustrates an example embodiment of a rapid-entry shoe of the present disclosure having a heel bow comprised of a portion of an upper.

In still other embodiments, and with reference to FIG. 5, a heel bow dynamic portion 132 of a heel bow 130 is comprised of a portion of an upper 120 extending from the medial side of the upper 120 and the lateral side of the upper 120, forming a window 136 at a rear portion of the rapid-entry shoe 100 (e.g., the window 136 closed with an upper panel as described above).

Optionally, and in connection with any of the foregoing embodiments, a rapid-entry shoe 100 in accordance with the present disclosure can further comprise a rear stabilizer coupled to the heel bow 130, a rear stabilizer configured to prevent inward deflection of the heel bow 130.

In general, a rear stabilizer can be configured to direct the heel bow 130 to compress downward and/or lean rearward (and prevent the heel bow 130 from deflecting inward, which would reduce the perimeter of the opening of rapid-entry shoe 100). In this regard, in example embodiments, a rear stabilizer is configured to prevent inward deflection of the heel bow 130 when the rapid entry shoe is deformed to an open configuration, as discussed below.

In some embodiments, a rear stabilizer is v-shaped, u-shaped, horse-shoe-shaped (with consistent or inconsistent curvature as it rounds the heel bow 130), or otherwise has an elongated shape, and thus extends around the heel bow 130. A rear stabilizer can be coupled to an inside or outside surface of heel bow 130, or be embedded within heel bow 130.

In example embodiments, a rear stabilizer comprises a mechanical property different from that of an adjacent heel bow 130, the mechanical property being one or more of material, cross-section, thickness, geometry, twisting and density. For instance, a rear stabilizer can comprise a reinforced section of heel bow 130. In example embodiments, a rear stabilizer is more rigid than adjacent heel bow 130.

Without limiting the foregoing, in some embodiments a rear stabilizer can be comprised of a thicker or more dense section of the same material of which heel bow 130 is comprised, but geometrically adjusted to provide stability to heel bow 130.

Optionally, a rapid-entry shoe 100 in accordance with the present disclosure can further comprise a flare coupled to the heel bow 130, the flare extending rearward and acting as a shoehorn (e.g., to direct a foot into the foot opening during entry).

In accordance with example embodiments of the present disclosure, the rapid-entry shoe 100 has a closed configuration (e.g., FIG. 1B). In accordance with example embodiments of the present disclosure, the rapid-entry shoe 100 has an open configuration (e.g., FIG. 1A) to facilitate donning and doffing of the rapid-entry shoe 100. In accordance with example embodiments of the present disclosure, the rapid-entry shoe 100 is biased by the heel bow 130 (or the heel bow dynamic portion 132) toward the closed configuration (FIG. 1B).

Figure 6A:
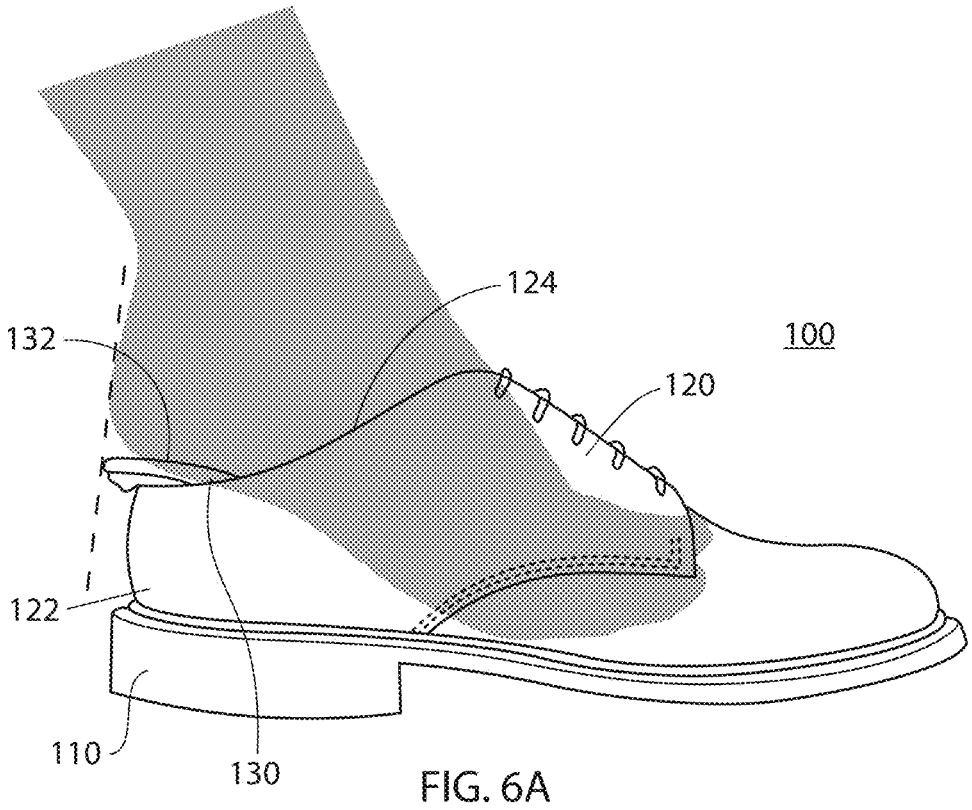
FIGS. 6A and 6B Illustrate another example embodiment of a rapid-entry shoe of the present disclosure having a heel bow dynamic portion in open and closed configurations, respectively.

In accordance with example embodiments of the present disclosure, and with reference to FIG. 6A, in an open configuration, the heel bow dynamic portion 132 is pivoted downward against the opening topline 124 and extends rearward beyond the heel portion 122 (e.g., with reference to the dotted line in FIG. 6A), to thereby expand the opening to facilitate entry of the foot into the rapid-entry shoe 100.

Figure 6B:
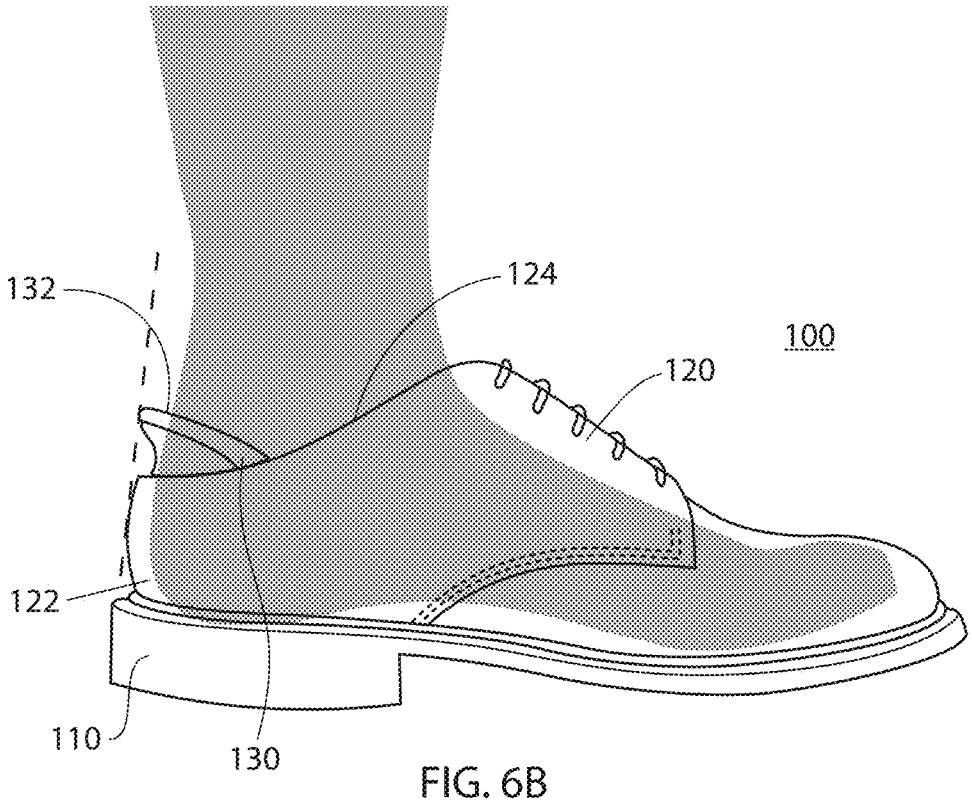

In accordance with example embodiments of the present disclosure, and with reference to FIG. 6B, in a closed configuration, the heel bow dynamic portion 132 is returned upward from against the opening topline 124 and no longer extends rearward beyond the heel portion 122 (e.g., with reference to the dotted line in FIG. 6B), to thereby narrow the opening to facilitate retention of the foot inside the rapid-entry shoe 100.

It will be apparent to those skilled in the art that various modifications and variations can be made in the present disclosure without departing from the spirit or scope of the disclosure.

Figure 7A:
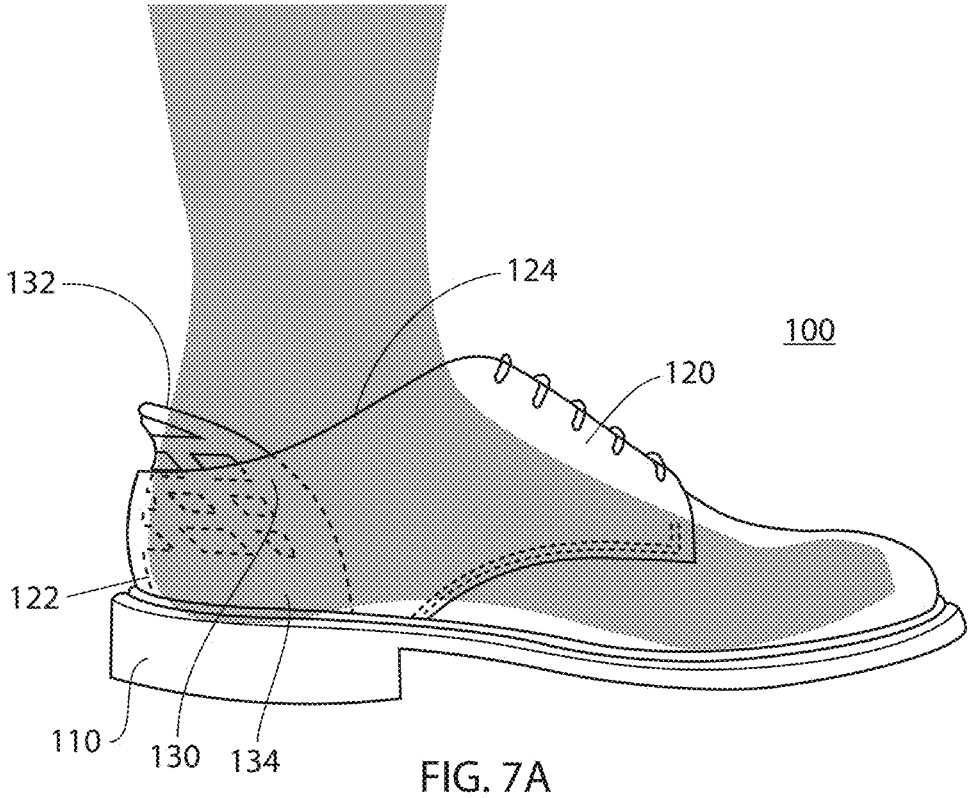
FIGS. 7A and 7B Illustrate example embodiments of heel bows comprising a plurality of deformable elements in accordance with the present disclosure.
Figure 7B:
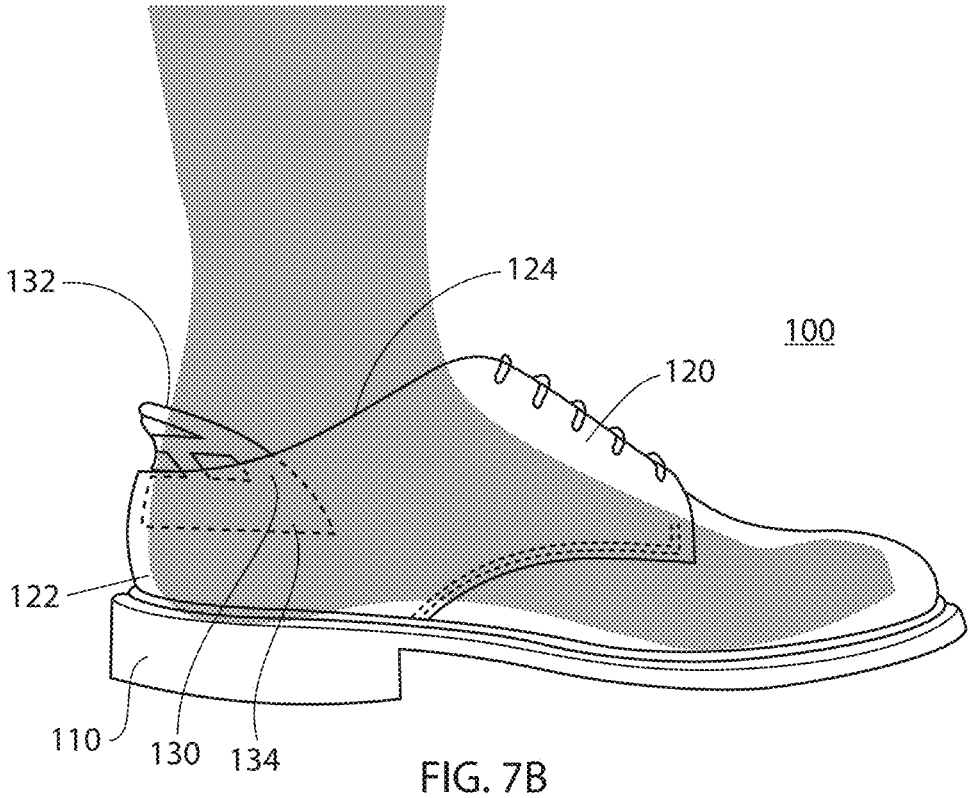

For example, a heel bow 130 can comprise a single deformable element (e.g., as described above) or a plurality of deformable elements arranged in parallel or in a lattice structure, example embodiments of which are illustrated in FIG. 7A (the heel bow 130 extending to and coupled to a sole portion 110) and in FIG. 7B (the heel bow 130 extending to and coupled to an upper 120).

Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A rapid-entry shoe comprising:

a sole portion;

an upper coupled to the sole portion, the upper comprising a heel portion extending around a rear portion of the rapid-entry shoe, and the upper comprising an opening defined at least in part by an opening topline for receiving a foot of a user, the heel portion including a static portion and an upper panel;

a heel bow extending between at least two layers of the upper around the rear portion of the rapid-entry shoe between a medial side of the sole portion and a lateral side of the sole portion, the heel bow extending upward and rearward from each of the medial side and the lateral side below the opening topline to converge at a heel bow dynamic portion located above the opening topline;

wherein the heel bow comprises a medial flange portion for coupling to the medial side of the sole portion and a lateral flange portion for coupling to the lateral side of the sole portion;

wherein the heel bow is resiliently deformable above the opening topline;

wherein the static portion of the heel portion is more rigid than the heel bow such that when the heel bow pivots the static portion resists deformation and the upper panel deforms with movement of the heel bow;

wherein, in an open configuration, the heel bow dynamic portion is pivoted downward against the opening topline to thereby expand the opening to facilitate entry of the foot into the rapid-entry shoe; and wherein, in a closed configuration, the heel bow dynamic portion is returned upward from against the opening topline to thereby narrow the opening to facilitate retention of the foot inside the rapid-entry shoe, and wherein a window is defined between the heel bow dynamic portion and the opening topline and the window is closed with the upper panel.

2. The rapid-entry shoe of claim 1 wherein, in the open configuration, the heel bow dynamic portion extends rearward beyond the heel portion; and wherein, in the closed configuration, the heel bow dynamic portion does not extend rearward beyond the heel portion.

3. The rapid-entry shoe of claim 1, wherein the heel bow moves relative to the upper below the opening topline during transition between the open configuration and the closed configuration.

4. The rapid-entry shoe of claim 1, wherein the heel bow dynamic portion is not positioned below the opening topline during transition between the open configuration and the closed configuration.

5. The rapid-entry shoe of claim 1, wherein the opening topline comprises a deflection zone to receive the heel bow dynamic portion in the open configuration.

6. The rapid-entry shoe of claim 1, wherein the static portion of the heel portion includes a heel counter, a heel collar, or a back strap.

7. The rapid-entry shoe of claim 1, wherein the upper panel of the heel portion is more flexible than both the heel bow dynamic portion and the static portion of the heel portion.

8. The rapid entry-shoe of claim 1, wherein the heel portion is level with or lower than a tongue portion.

9. The rapid-entry shoe of claim 1, wherein the heel bow dynamic portion is configured to deflect over the heel portion during transition to the open configuration.

10. The rapid-entry shoe of claim 1, wherein the heel bow dynamic portion is configured to deflect rearward of the heel portion during transition to the open configuration.

* * * * *